US011663956B2

(12) United States Patent
Lee et al.

(10) Patent No.: US 11,663,956 B2
(45) Date of Patent: May 30, 2023

(54) PIXEL, DISPLAY DEVICE INCLUDING THE PIXEL, AND METHOD OF DRIVING THE DISPLAY DEVICE

(71) Applicant: Samsung Display Co., Ltd., Yongin-si (KR)

(72) Inventors: Chang-Soo Lee, Suwon-si (KR); Boyong Chung, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/588,806

(22) Filed: Jan. 31, 2022

(65) Prior Publication Data

US 2022/0351672 A1 Nov. 3, 2022

(30) Foreign Application Priority Data

Apr. 28, 2021 (KR) ..... 10-2021-0054828

(51) Int. Cl.
*G09G 3/32* (2016.01)

(52) U.S. Cl.
CPC ..... *G09G 3/32* (2013.01); *G09G 2300/0842* (2013.01); *G09G 2310/0243* (2013.01); *G09G 2310/0272* (2013.01); *G09G 2310/06* (2013.01); *G09G 2310/08* (2013.01); *G09G 2320/0266* (2013.01)

(58) Field of Classification Search
CPC ..... G09G 3/32–3291; G09G 2230/00; G09G 2300/043; G09G 2300/0819; G09G 2300/0842; G09G 2300/0861–0871; G09G 2310/0243; G09G 2310/0251; G09G 2310/0267; G09G 2310/0272; G09G 2310/0289; G09G 2310/06; G09G 2310/066; G09G 2310/08; G09G 2320/02; G09G 2320/0223; G09G 2320/0233;

(Continued)

(56) References Cited

U.S. PATENT DOCUMENTS 11,322,077 B1 * 5/2022 Chun ..... G09G 3/3208
2015/0179107 A1 * 6/2015 Kim ..... G09G 3/3233 345/82

(Continued)

FOREIGN PATENT DOCUMENTS

KR 1020180078928 A 7/2018
KR 1020190057564 A 5/2019
KR 1020200010689 A 1/2020

*Primary Examiner* — Nathan Danielsen
(74) *Attorney, Agent, or Firm* — Cantor Colburn LLP

(57) ABSTRACT

A pixel includes: a light emitting element; a first transistor which drives the light emitting element; a second transistor electrically connected between a gate node of the first transistor and a data line; a third transistor electrically connected between a first node of the first transistor and an initialization voltage line; and a storage capacitor electrically connected between the gate node and the first node of the first transistor. Here, upon an operation in a variable frame mode, an initialization voltage is applied to the initialization voltage line, and the initialization voltage has a first voltage level. In addition, in a data writing period during which the storage capacitor is charged with an electric charge, the initialization voltage further includes a pulse voltage such that the initialization voltage has a second voltage level that is greater than the first voltage level.

16 Claims, 8 Drawing Sheets

(58) Field of Classification Search
CPC ... G09G 2320/0242; G09G 2320/0252; G09G 2320/0613; G09G 2320/0686
See application file for complete search history.

(56) References Cited

U.S. PATENT DOCUMENTS

| | | | | |
|---|---|---|---|---|
| 2018/0061913 | A1* | 3/2018 | Kim | G09G 3/3225 |
| 2019/0114966 | A1* | 4/2019 | Park | G09G 3/2003 |
| 2020/0066207 | A1* | 2/2020 | Gu | G09G 3/3266 |

* cited by examiner

PIXEL, DISPLAY DEVICE INCLUDING THE PIXEL, AND METHOD OF DRIVING THE DISPLAY DEVICE

This application claims priority to Korean Patent Application No. 10-2021-0054828 filed on Apr. 28, 2021, and all the benefits accruing therefrom under 35 U.S.C. § 119, the content of which in its entirety is herein incorporated by reference.

BACKGROUND

1. Field

Embodiments relate generally to a display device. More particularly, embodiments relate to a pixel that supports a variable frame mode, a display device including the pixel, and a method of driving the display device.

2. Description of the Related Art

In general, a display device is configured to display (or refresh) an image at a constant frame rate of 60 Hertz (Hz) or higher. However, a frame rate of rendering performed by a host processor (e.g., a graphic processing unit ("GPU") or a graphic card) configured to provide frame data to the display device may not match a refresh frame rate of the display device. In particular, when the host processor provides frame data for a game image that needs complex rendering to the display device, such frame rate mismatch may be intensified, and a tearing phenomenon in which a boundary line is generated in the image displayed by the display device may be caused by the frame rate mismatch.

In order to prevent such a tearing phenomenon, a variable frame mode (e.g., a Free-Sync mode or a G-Sync mode) in which the host processor provides the frame data to the display device at a variable frame rate by varying a blank period for every frame have been developed. The display device that supports the variable frame mode may prevent the tearing phenomenon by displaying (or refreshing) the image in synchronization with the variable frame rate.

SUMMARY

However, according to the display device operating in the variable frame mode, due to a difference between an initialization period in a low-frequency region and an initialization period in a high-frequency region, a decrease in a luminance of a display panel and deterioration of image quality may be caused.

An aspect of the present disclosure is to provide a pixel capable of improving image quality in a variable frame mode.

Another aspect of the present disclosure is to provide a display device capable of improving image quality in a variable frame mode.

Still another aspect of the present disclosure is to provide a method of driving a display device, capable of improving image quality in a variable frame mode.

According to embodiments, a pixel includes: a light emitting element; a first transistor which drives the light emitting element; a second transistor electrically connected between a gate node of the first transistor and a data line; a third transistor electrically connected between a first node of the first transistor and an initialization voltage line; and a storage capacitor electrically connected between the gate node and the first node of the first transistor. Here, upon an operation in a variable frame mode, an initialization voltage is applied to the initialization voltage line, and the initialization voltage has a first voltage level. In addition, in a data writing period during which the storage capacitor is charged with an electric charge, the initialization voltage further includes a pulse voltage such that the initialization voltage has a second voltage level that is greater than the first voltage level.

In an embodiment, a scan signal for controlling input of a data voltage may be applied to a gate node of the second transistor, and an initialization signal for controlling input of the initialization voltage may be applied to a gate node of the third transistor.

In an embodiment, in the data writing period, the scan signal and the initialization signal may simultaneously rise to activation levels thereof, respectively, and the initialization signal may fall to an inactivation level thereof after the scan signal falls to an inactivation level thereof.

In an embodiment, the initialization voltage may rise to the second voltage level, after the scan signal falls to the inactivation level thereof and before the initialization signal falls to the inactivation level thereof.

In an embodiment, the initialization voltage may fall to the first voltage level, after the initialization signal falls to the inactivation level thereof.

In an embodiment, in the data writing period, a turn-on timing of the second transistor may be identical to or substantially the same as a turn-on timing of the third transistor, and a turn-off timing of the third transistor may be after a turn-off timing of the second transistor.

In an embodiment, the initialization voltage may rise to the second voltage level after the second transistor is turned off and before the third transistor is turned off.

In an embodiment, the initialization voltage may fall to the first voltage level after the third transistor is turned off.

In an embodiment, the second voltage level may be identical to or substantially the same as a voltage level of a threshold voltage of the light emitting element.

In an embodiment, the second voltage level may be settable between the first voltage level and a voltage level of a threshold voltage of the light emitting element.

According to embodiments, a display device includes: a display panel including a plurality of pixels; a data driver which provides data voltages to the pixels; a gate driver which provides a scan signal and an initialization signal to the pixels; a power supply voltage generation circuit which provides a driving voltage to the data driver and the pixels; and a controller which controls the data driver, the gate driver, and the power supply voltage generation circuit. Here, upon an operation in a variable frame mode, the power supply voltage generation circuit provides an initialization voltage to the pixels, and the initialization voltage has a first voltage level. In addition, in a data writing period, the initialization voltage further includes a pulse voltage such that the initialization voltage has a second voltage level that is greater than the first voltage level.

In an embodiment, in the data writing period, the scan signal and the initialization signal may simultaneously rise to activation levels thereof, respectively, and the initialization signal may fall to an inactivation level thereof after the scan signal falls to an inactivation level thereof.

In an embodiment, the power supply voltage generation circuit may increase the initialization voltage to the second voltage level after the scan signal falls to the inactivation level thereof and before the initialization signal falls to the inactivation level thereof.

In an embodiment, the power supply voltage generation circuit may decrease the initialization voltage to the first voltage level after the initialization signal falls to the inactivation level thereof.

In an embodiment, the pixel may include: a light emitting element; a first transistor which drives the light emitting element; a second transistor electrically connected between a gate node of the first transistor and a data line; a third transistor electrically connected between a first node of the first transistor and an initialization voltage line; and a storage capacitor electrically connected between the gate node and the first node of the first transistor.

In an embodiment, the second voltage level may be identical to or substantially the same as a voltage level of a threshold voltage of the light emitting element.

According to embodiments, a method of driving a display device includes: providing an initialization voltage to a pixel, where the initialization voltage has a first voltage level; providing a scan signal to the pixel; providing an initialization signal to the pixel; and controlling the initialization voltage. Here, in a data writing period, the initialization voltage further includes a pulse voltage such that the initialization voltage has a second voltage level that is greater than the first voltage level.

In an embodiment, in the data writing period, the scan signal and the initialization signal may simultaneously rise to activation levels thereof, respectively, and the initialization signal may fall to an inactivation level thereof after the scan signal falls to an inactivation level thereof.

In an embodiment, controlling the initialization voltage may include: increasing the initialization voltage to the second voltage level after the scan signal falls to the inactivation level thereof and before the initialization signal falls to the inactivation level thereof.

In an embodiment, controlling the initialization voltage may include: decreasing the initialization voltage to the first voltage level after the initialization signal falls to the inactivation level thereof.

Therefore, a pixel, a display device including the pixel, and a method of driving the display device according to embodiments may prevent a decrease in a luminance caused by a difference between an initialization period in a low-frequency region and an initialization period in a high-frequency region and may effectively improve image quality by providing an initialization voltage to the pixel as a pulse voltage when operating in a variable frame mode.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"substantially the same" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "substantially the same" can mean within one or more standard deviations, or within ±30%, 20%, 10% or 5% of the stated value.

Hereinafter, embodiments of the present disclosure will be explained in detail with reference to the accompanying drawings.

Figure 1:
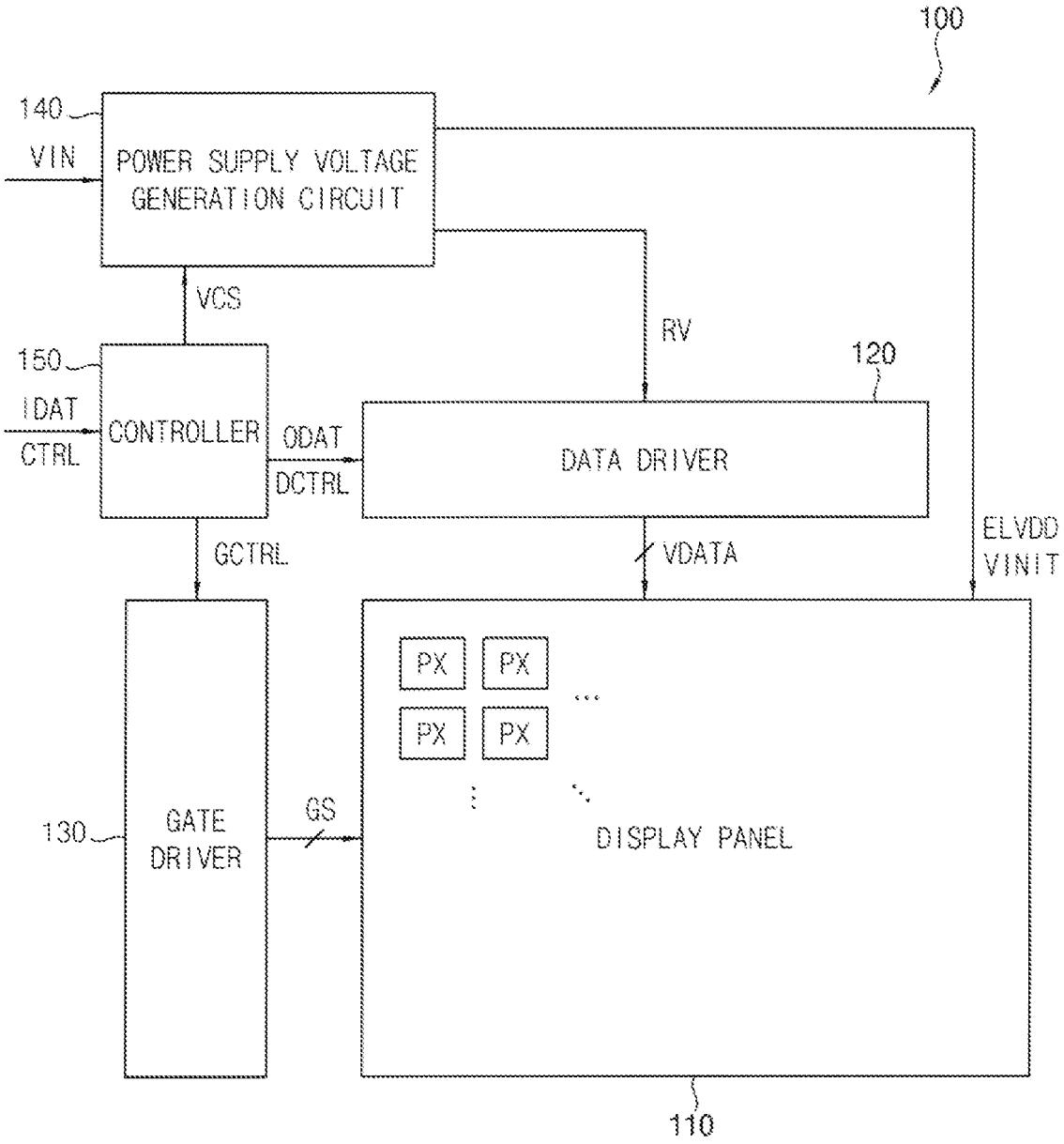
FIG. 1 is a block diagram showing a display device according to embodiments.
Figure 2:
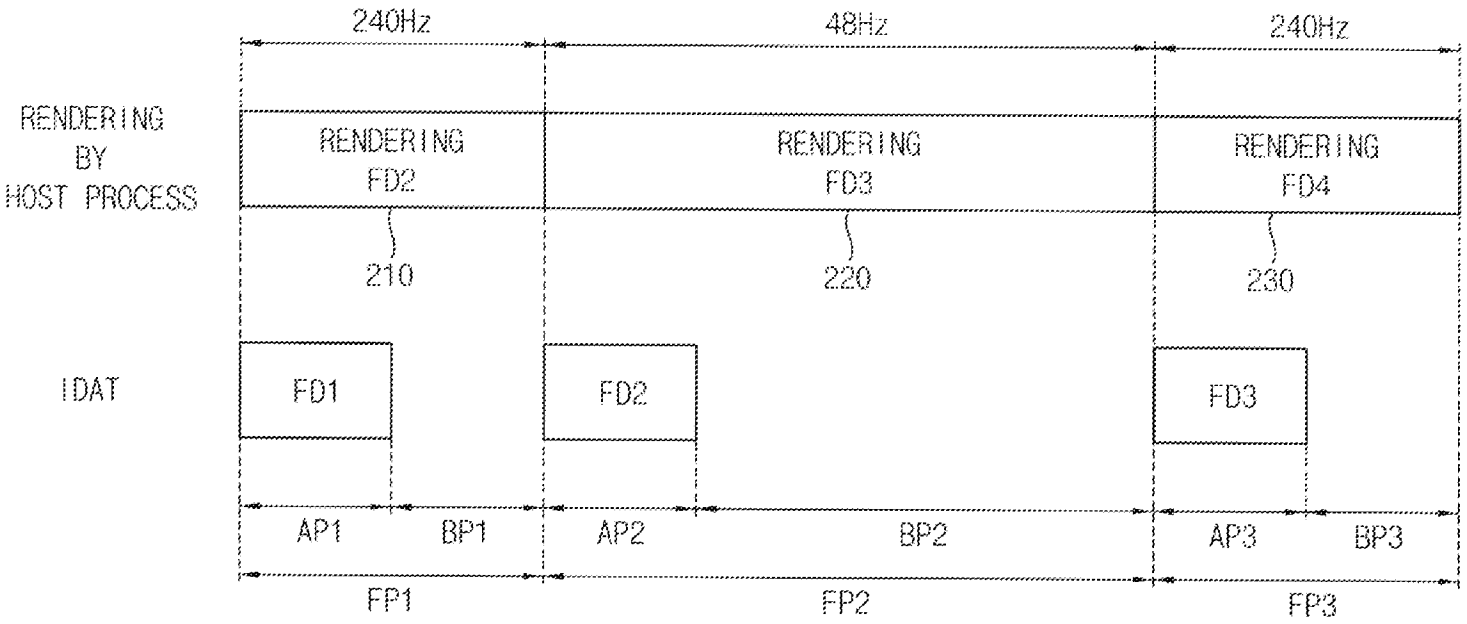
FIG. 2 is a diagram showing an example of frame data input to the display device of FIG. 1 in a variable frame mode.

FIG. 1 is a block diagram showing a display device according to embodiments, and FIG. 2 is a diagram showing an example of frame data input to the display device of FIG. 1 in a variable frame mode.

Referring to FIG. 1, a display device 100 may include a display panel 110 including a plurality of pixels PX, a data driver 120 which provides data voltages VDATA to the pixels PX, a gate driver 130 which provides gate signals GS to the pixels PX, a power supply voltage generation circuit 140 which generates display panel driving voltages RV, VINIT, and ELVDD, and a controller 150 which controls the data driver 120, the gate driver 130, and the power supply voltage generation circuit 140.

The display panel 110 may include a plurality of data lines, a plurality of gate lines, and a plurality of pixels PX connected to the data lines and the gate lines, respectively.

In an embodiment, each of the pixels PX may include a transistor and a capacitor connected to the transistor.

The data driver 120 may generate the data voltages VDATA based on image data ODAT and a data control signal DCTRL output from the controller 150, and provide the data voltages VDATA to the pixels PX. For example, the data control signal DCTRL may include an output data enable signal, a horizontal start signal, and a load signal, but embodiments are not limited thereto. The data driver 120 may receive a reference voltage RV (e.g., a gamma reference voltage) from the power supply voltage generation circuit 140. Here, the data driver 120 may generate the data voltage VDATA based on the reference voltage RV. In an embodiment, the data driver 120 may be implemented with at least one data integrated circuit ("IC"). In addition, in some embodiments, the data driver 120 may be directly mounted on the display panel 110, or may be connected to the display panel 110 in a form of a tape carrier package ("TCP"). In another embodiment, the data driver 120 may be integrated in a peripheral part of the display panel 110.

The gate driver 130 may generate the gate signals GS based on a gate control signal GCTRL output from the controller 150, and provide the gate signals GS to the pixels PX. In an embodiment, the gate control signal GCTRL may include a frame start signal and a gate clock signal, but the embodiments are not limited thereto. In an embodiment, the gate driver 130 may be implemented as an amorphous silicon gate ("ASG") driver integrated in the peripheral part of the display panel 110. In another embodiment, the gate driver 130 may be implemented with at least one gate IC. In addition, in some embodiments, the gate driver 130 may be directly mounted on the display panel 110, or may be connected to the display panel 110 in a form of a TCP.

The power supply voltage generation circuit 140 may generate the reference voltage RV that will be provided to the data driver 120. For example, the power supply voltage generation circuit 140 may receive an input voltage VIN from an external power source, generate the reference voltage RV based on the input voltage VIN, and provide the reference voltage RV to the data driver 120. The data driver 120 may generate the data voltages VDATA based on the reference voltage RV provided from the power supply voltage generation circuit 140. For example, the data driver 120 may generate grayscale voltages (e.g., 256 grayscale voltages) corresponding to entire grayscale levels (e.g., a 0-grayscale level to a 255-grayscale level) based on the reference voltage RV, respectively, and provide the grayscale voltages corresponding to grayscale levels indicated by the image data ODAT output from the controller 150 to the pixels PX as the data voltages VDATA. In an embodiment, the reference voltage RV may include a positive reference voltage and a negative reference voltage, and the data driver 120 may provide positive data voltages VDATA to the pixels PX based on the positive reference voltage and provide negative data voltages VDATA to the pixels PX based on the negative reference voltage. In addition, the power supply voltage generation circuit 140 may provide an initialization voltage VINIT and a first power supply voltage ELVDD to the pixels PX. Further, in an embodiment, the power supply voltage generation circuit 140 may further generate an analog driving voltage supplied to the data driver 120 and the controller 150, a common voltage supplied to the display panel 110, a gate driving voltage (e.g., a high gate voltage and a low gate voltage) supplied to the gate driver 130, and the like based on the input voltage VIN. In addition, in an embodiment, the power supply voltage generation circuit 140 may be implemented as a power management integrated circuit ("PMIC") disposed on a control board on which the controller 150 is disposed.

The controller 150 (e.g., a timing controller ("T-CON")) may receive input image data IDAT and a control signal CTRL from an external host processor (e.g., a graphic processing unit ("GPU") or a graphic card). In an embodiment, the input image data IDAT may be RGB data including red image data, green image data, and blue image data. In addition, in an embodiment, the control signal CTRL may include a vertical synchronization signal, a horizontal synchronization signal, an input data enable signal, a master clock signal, and the like, but the embodiments are not limited thereto. The controller 150 may generate the gate control signal GCTRL, the data control signal DCTRL, and the output image data ODAT based on the input image data IDAT and the control signal CTRL. The controller 150 may provide the data control signal DCTRL and the output image data ODAT to the data driver 120 to control an operation of the data driver 120, and provide the gate control signal GCTRL to the gate driver 130 to control an operation of the gate driver 130.

According to embodiments of the present disclosure, the controller 150 may support a variable frame mode in which the host processor provides the input image data IDAT to the display device 100 at a variable frame rate by varying a blank period for every frame period, and the controller 150 provides the output image data ODAT to the data driver 120 in synchronization with the variable frame rate so that an image is displayed (or refreshed) at the variable frame rate. The variable frame mode may be referred to as a Free-Sync mode, a G-Sync mode, or the like.

In an embodiment, for example, as shown in FIG. 2, periods or frequencies of rendering 210, 220, and 230 of the host processor (e.g., a GPU or a graphic card) may not be constant (especially when rendering game image data), and the host processor may provide the input image data IDAT, that is, frame data FD1, FD2, and FD3 to the display device 100 in synchronization with the inconstant periods or frequencies of the rendering 210, 220, and 230 in the variable frame mode, respectively. In other words, in the variable frame mode, frames FP1, FP2, and FP3 may have constant active periods AP1, AP2, and AP3 having a constant time, respectively, and the host processor may provide the frame data FD1, FD2, and FD3 to the display device 100 at a variable frame rate by varying times of variable blank periods BP1, BP2, and BP3 of the frames FP1, FP2, and FP3. That is, the active periods AP1, AP2, and AP3 may be the same regardless of the variable frame mode, and the variable blank periods BP1, BP2, and BP3 may be different from each other depending on the variable frame mode.

According to the example of FIG. 2, in a first frame FP1, during which second frame data FD2 is rendered (210) at a frequency of about 240 Hz, the host processor may provide first frame data FD1 to the display device 100 at a frame rate of about 240 Hz. In addition, the host processor may output the second frame data FD2 during the active period AP2 of a second frame FP2, and continue the variable blank period BP2 of the second frame FP2 until the rendering (220) of third frame data FD3 is completed. Therefore, in the second frame FP2, during which the third frame data FD3 is rendered (220) at a frequency of about 48 Hz, the host processor may increase the time of the variable blank period BP2 of the second frame FP2 to provide the second frame data FD2 to the display device 100 at a frame rate of about 48 Hz. In a third frame FP3, during which fourth frame data FD4 is rendered (230) at the frequency of about 240 Hz, the host processor may provide the third frame data FD3 to the display device 100 at the frame rate of about 240 Hz.

Figure 3:
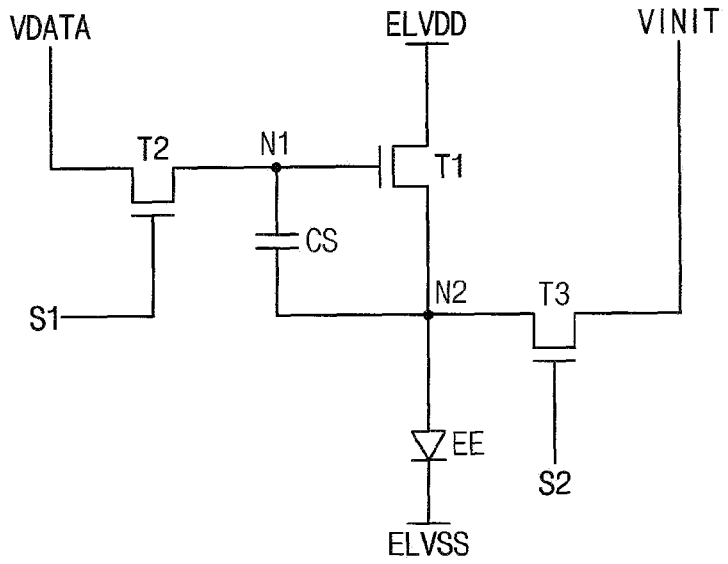
FIG. 3 (PRIOR ART)
FIG. 3 is a circuit diagram showing a pixel in FIG. 1.
Figure 4:
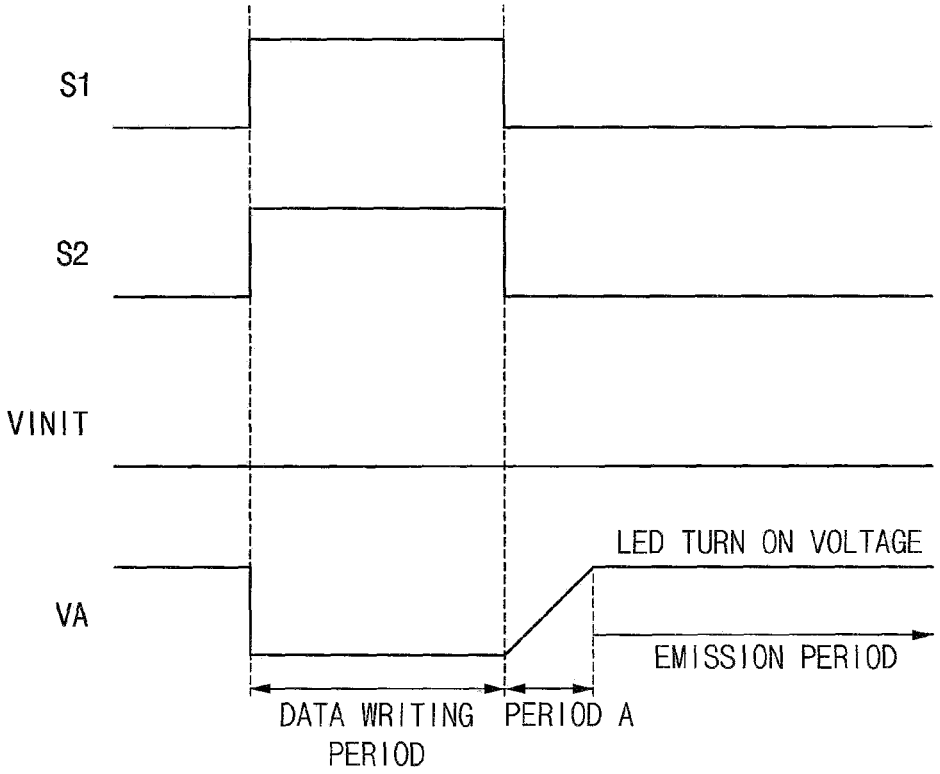
FIG. 4 (PRIOR ART)
FIG. 4 is a timing diagram showing a conventional input signal and a conventional output signal of the pixel of FIG. 3.
Figure 5:
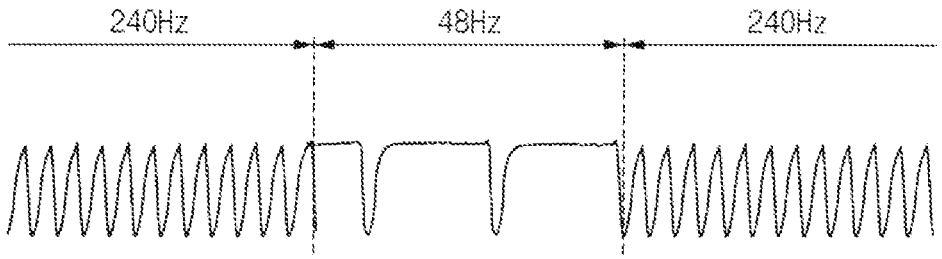
FIG. 5 is a diagram showing a variation in an initialization period of the pixel of FIG. 3 in a variable frame mode.

FIG. 3 is a circuit diagram showing a pixel in FIG. 1, FIG. 4 is a timing diagram showing a conventional input signal and a conventional output signal of the pixel of FIG. 3, and FIG. 5 is a diagram showing a variation in an initialization period of the pixel of FIG. 3 in a variable frame mode.

Referring to FIGS. 1 to 5, the pixel PX may include at least one transistor and at least one capacitor. A light emitting element (e.g., light emitting diode) EE may be provided as a light emitting element. For example, the pixel PX may include a first transistor T1, a second transistor T2, a third transistor T3, a storage capacitor CS, and a light emitting element EE. The gate signal GS may include a scan signal S1 and an initialization signal S2. The gate lines may include a scan line and an initialization line.

The second transistor T2 may be configured such that the scan signal S1 is applied to a gate node of the second transistor T2 through the scan line so as to control an on/off state of the second transistor T2. In other words, the scan signal S1 for controlling input of the data voltage VDATA may be applied to the gate node of the second transistor T2. The third transistor T3 may be configured such that the initialization signal S2 that is different from the scan signal S1 is applied to a gate node of the third transistor T3 through the initialization line so as to control an on-off state of the third transistor T3. In other words, the initialization signal S2 for controlling input of the initialization voltage VINIT may be applied to the gate node of the third transistor T3.

The first transistor T1 may include a first node N1 and a second node N2. The first node N1 of the first transistor T1 may be a gate node to which the data voltage VDATA is applied through the data line when the second transistor T2 is turned on. The second node N2 of the first transistor T1 may be electrically connected to an anode electrode of the light emitting element EE, and may be a source node or a drain node.

The second transistor T2 may be electrically connected between the first node N1 of the first transistor T1 and the data line, and the scan line may be connected to the gate node of the second transistor T2 so that the second transistor T2 may operate according to the scan signal S1 supplied through the scan line. In addition, when the second transistor T2 is turned on, the second transistor T2 may transmit the data voltage VDATA supplied through the data line to the gate node of the first transistor T1.

The third transistor T3 may be electrically connected between the second node N2 of the first transistor T1 and the initialization voltage line, and the gate line may be connected to the gate node of the third transistor T3 so that the third transistor T3 may operate according to the initialization signal S2 supplied through the initialization line. When the third transistor T3 is turned on, the third transistor T3 may transmit the initialization voltage VINIT supplied through the initialization voltage line to the second node N2 of the first transistor T1. In other words, the second transistor T2 and the third transistor T3 may be controlled, so that a driving current for light emission may be supplied to the light emitting element EE by the first transistor T1.

The transistor disposed in the pixel PX may be configured as a p-type transistor as well as an n-type transistor. However, according to the present embodiment, a case in which the transistor disposed in the pixel PX is configured as the n-type transistor has been illustrated.

The storage capacitor CS may be electrically connected between the first node N1 and the second node N2 of the first transistor T1, and may maintain the data voltage VDATA for one frame.

The storage capacitor CS may be connected between the first node N1 and another node of the first transistor T1 depending on a type of the first transistor T1. The anode electrode of the light emitting element EE may be electrically connected to the second node N2 of the first transistor T1, and a base voltage ELVSS may be applied to a cathode electrode of the light emitting element EE. Here, the base voltage ELVSS may be a ground voltage, or a voltage that is higher or lower than the ground voltage. In addition, the base voltage ELVSS may vary according to a driving state.

Image driving in which the pixel PX emits light may proceed in a data writing period and an emission period. In the data writing period, the scan signal S1 and the initialization signal S2 may have activation levels. In the emission period, the scan signal S1 and the initialization signal S2 may have inactivation levels.

Application of the data voltage VDATA for the image driving to the first node N1 of the first transistor T1 may be referred to as data writing. In the data writing period, the data voltage VDATA corresponding to an image signal may be applied to the first node N1 of the first transistor T1, and the initialization voltage VINIT may be applied to the second node N2 of the first transistor T1. In other words, the data writing period may include an initialization period in which the initialization voltage VINIT is applied to the second node N2. The data writing period may be substantially the same as the initialization period. In the data writing period, the storage capacitor CS may be charged with an electric charge corresponding to a potential difference (VDATA−VINIT) between opposite ends of the storage capacitor CS.

A voltage of the anode electrode of the light emitting element EE may be denoted by VA. Before the initialization period, the voltage VA of the anode electrode of the light emitting element EE may have a level corresponding to ELVSS+VEL due to the data voltage VDATA of a previous frame. Here, VEL may denote a threshold voltage of the light emitting element EE. In the data writing period (or the initialization period), the voltage VA of the anode electrode of the light emitting element EE may be the initialization voltage VINIT.

Referring to FIG. 4, at the start of the data writing period, the scan signal S1 and the initialization signal S2 may simultaneously rise to the activation levels. Therefore, a turn-on timing of the second transistor T2 may be identical to or substantially the same as a turn-on timing of the third transistor T3.

In the data writing period, the first node N1 and the second node N2 of the first transistor T1 may electrically float. To this end, the second transistor T2 may be turned off by the scan signal S1 having a turn-off level. In addition, the third transistor T3 may be turned off by the initialization signal S2 having a turn-off level. Referring to FIG. 4, at the end of the data writing period, the scan signal S1 and the initialization signal S2 may simultaneously fall to the inactivation levels. Therefore, a turn-off timing of the second transistor T2 may be identical to or substantially the same as a turn-off timing of the third transistor T3.

At the end of the data writing period, while a voltage difference between the first node N1 and the second node N2 of the first transistor T1 is maintained, a voltage of each of the first and second nodes N1 and N2 of the first transistor T1 may be boosted. In other words, in a period A after the end of the data writing period, the voltage VA of the anode electrode of the light emitting element EE may gradually increase. While the voltage VA of the anode electrode of the light emitting element EE gradually increases, when the voltage VA of the anode electrode has a voltage level that is greater than or equal to a voltage level that may turn on the light emitting element EE, the emission period may be entered.

In the emission period, the driving current may flow to the light emitting element EE, so that the light emitting element EE may emit light. The first transistor T1 disposed in each of the pixels PX may have a unique characteristic value such as a threshold voltage and mobility. Since deterioration of the first transistor T1 may occur according to a driving time, the unique characteristic value of the first transistor T1 may vary according to the driving time.

In the variable frame mode, due to a difference between an initialization period in a low-frequency region and an initialization period in a high-frequency region, a decrease in a luminance of the display panel 110 and deterioration of image quality may be caused. As shown in FIG. 5, in the variable frame mode, the initialization period in the low-frequency region and the initialization period in the high-frequency region may vary. The number of initialization periods in the low-frequency region (e.g., 48 Hz) may be smaller than the number of initialization periods in the high-frequency region (e.g., 240 Hz). When the low-frequency region and the high-frequency region are repeatedly driven, due to a difference between the numbers of the initialization periods, a parallel capacitance of the light emitting element EE may not be fully charged, and the deterioration of image quality may be caused.

In contrast, according to the display device 100 of the present disclosure, upon an operation in the variable frame mode, the initialization voltage VINIT may be provided to the pixel PX as a pulse voltage, so that the decrease in the luminance caused by the difference between the initialization period in the low-frequency region and the initialization period in the high-frequency region may be prevented, and the image quality may be effectively improved.

Figure 6:
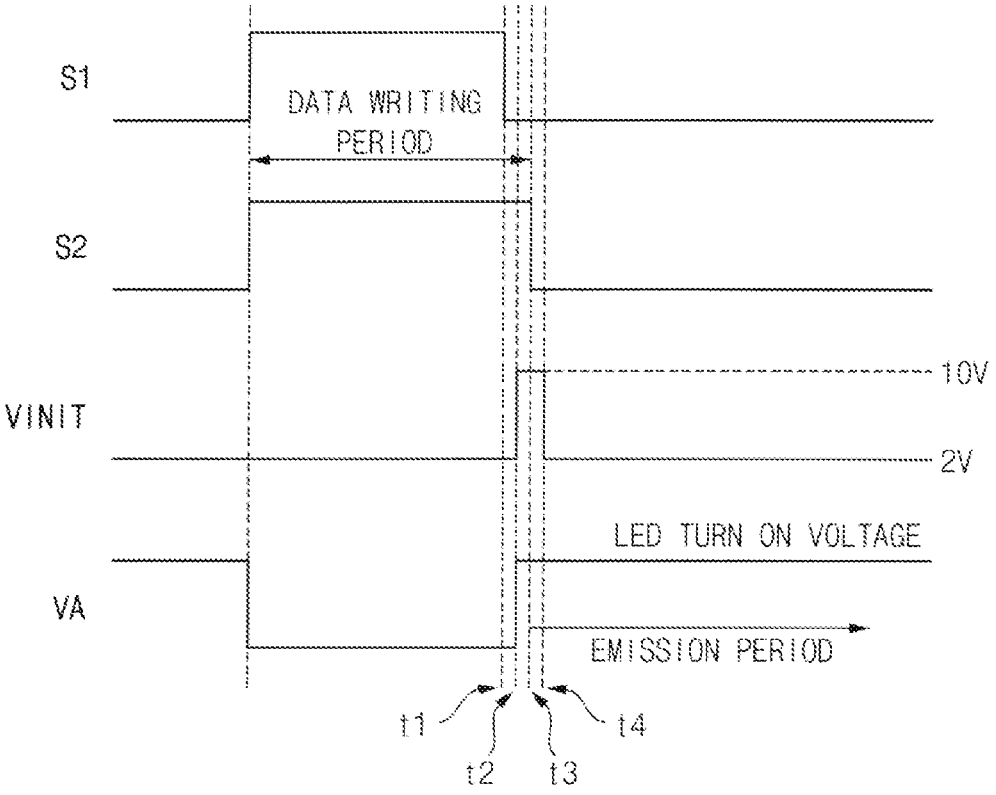
FIG. 6 is a timing diagram showing an input signal and an output signal of the pixel of FIG. 3 according to embodiments.
Figure 7:
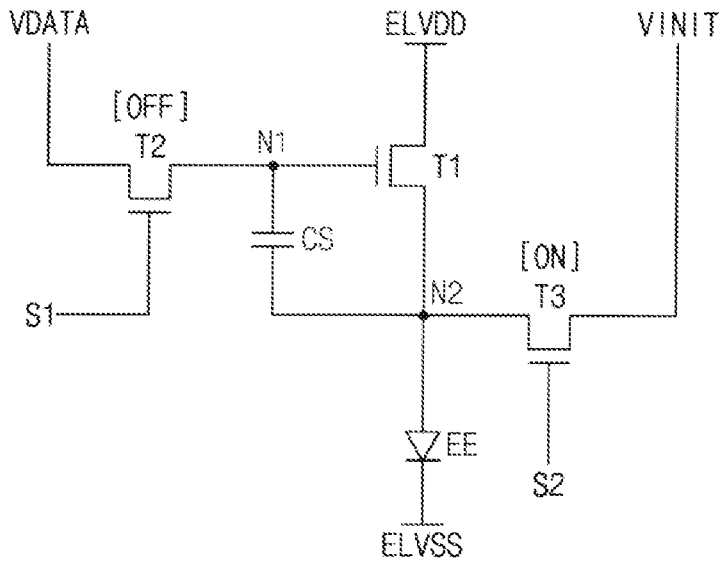
FIG. 7 is a circuit diagram showing the pixel of FIG. 3 in a period between t1 and t2 in FIG. 6.
Figure 8:
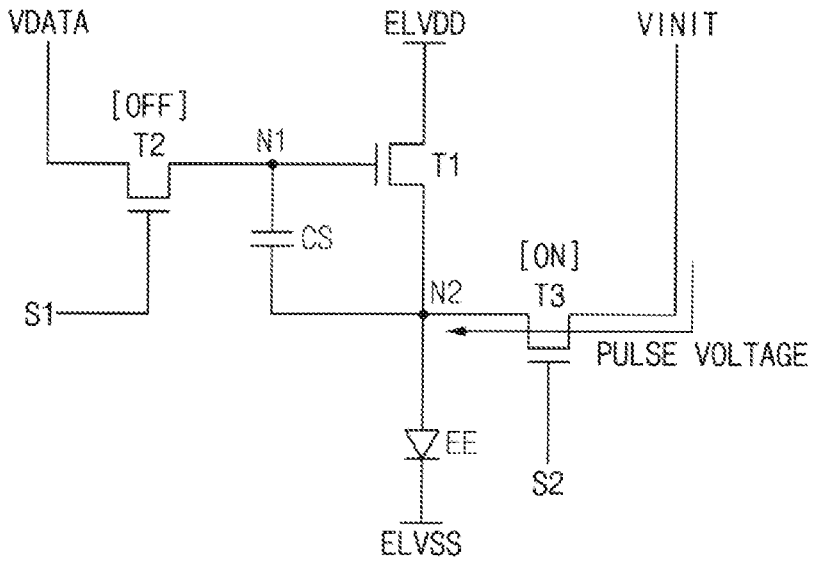
FIG. 8 is a circuit diagram showing the pixel of FIG. 3 in a period between t2 and t3 in FIG. 6.
Figure 9:
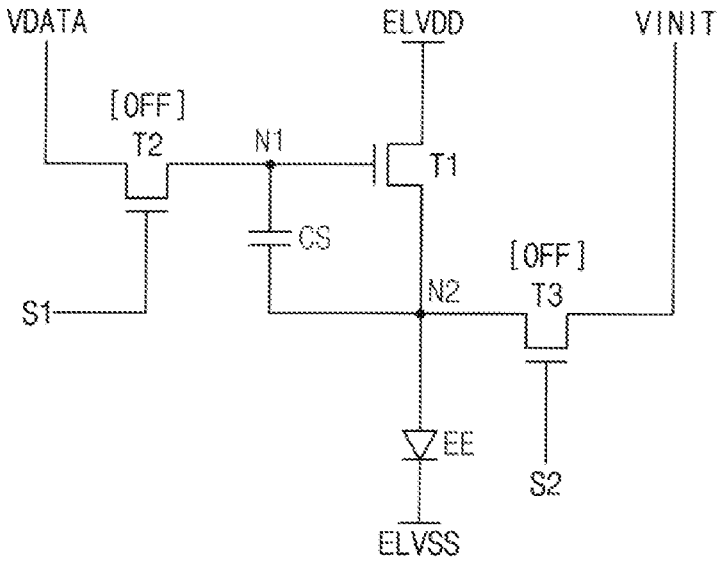
FIG. 9 is a circuit diagram showing the pixel of FIG. 3 in a period between t3 and t4 in FIG. 6.

FIG. 6 is a timing diagram showing an input signal and an output signal of the pixel of FIG. 3 according to embodiments, FIG. 7 is a circuit diagram showing the pixel of FIG. 3 in a period between t1 and t2 in FIG. 6, FIG. 8 is a circuit diagram showing the pixel of FIG. 3 in a period between t2 and t3 in FIG. 6, and FIG. 9 is a circuit diagram showing the pixel of FIG. 3 in a period between t3 and t4 in FIG. 6.

Referring to FIGS. 1 and 6 to 9, upon the operation in the variable frame mode, the power supply voltage generation circuit 140 may provide an initialization voltage VINIT having a first voltage level (e.g., 2 V) to the pixels PX. In the data writing period, the initialization voltage VINIT may further include a pulse voltage such that the initialization voltage VINIT may have a second voltage level (e.g., 10 V) that is greater than the first voltage level.

As shown in FIG. 6, at the start of the data writing period, the scan signal S1 and the initialization signal S2 may simultaneously rise to the activation levels. Therefore, the turn-on timing of the second transistor T2 may be identical to or substantially the same as the turn-on timing of the third transistor T3. The data writing period may include an initialization period. In the initialization period, the voltage VA of the anode electrode of the light emitting element EE may be the initialization voltage VINIT having the first voltage level (e.g., 2 V).

At the end of the data writing period, the initialization signal S2 may fall to the inactivation level after the scan signal S1 falls to the inactivation level. In other words, the turn-off timing of the third transistor may be after the turn-off timing of the second transistor.

At the end of the data writing period, the initialization voltage VINIT may further include a pulse voltage such that the initialization voltage VINIT may have the second voltage level that is greater than the first voltage level. In other words, the power supply voltage generation circuit 140 may increase the initialization voltage VINIT from the first voltage level to the second voltage level for a short time and to fall back to the first voltage level. Referring to FIG. 6, the initialization voltage VINIT may rise to the second voltage level (e.g., 10 V) for the short time (e.g., a time corresponding to t4–t2: time duration from t2 to t4), and fall back to the first voltage level (e.g., 2 V). For example, the second voltage level may be equal to a voltage level of the threshold voltage of the light emitting element EE. As another example, the second voltage level may be settable between the first voltage level and the voltage level of the threshold voltage of the light emitting element.

When the initialization voltage VINIT further includes the pulse voltage such that the initialization voltage VINIT has the second voltage level, a capacitance connected in parallel with the light emitting element EE may be rapidly charged. As described above, when the capacitance connected in parallel with the light emitting element EE is rapidly charged, the voltage VA of the anode electrode may rapidly reach the voltage level that may turn on the light emitting element EE, so that the image driving of the pixel PX may rapidly enter the emission period. Therefore, the decrease in the luminance caused by the difference between the initialization period in the low-frequency region and the initialization period in the high-frequency region may be reduced.

In an embodiment, the initialization voltage VINIT may include the pulse voltage that rises to the second voltage level after the scan signal S1 falls to the inactivation level and before the initialization signal S2 falls to the inactivation level. Referring to FIG. 6, in the data writing period, the scan signal S1 may fall to the inactivation level at t1. The initialization signal S2 may fall to the inactivation level at t3 after t1. The initialization voltage VINIT may rise to the second voltage level in a period between t1 and t3. In other words, the initialization voltage VINIT may rise to the second voltage level (e.g., 10 V) after the second transistor T2 is turned off and before the third transistor T3 is turned off.

In an embodiment, the initialization voltage VINIT may include the pulse voltage that falls to the first voltage level after the initialization signal falls to the inactivation level. Referring to FIG. 6, the initialization voltage VINIT may fall to the first voltage level after t3. In other words, the initialization voltage VINIT may fall to the first voltage level after the third transistor T3 is turned off.

In detail, in the data writing period, the scan signal S1 may fall to the inactivation level at t1. Referring to FIG. 7, in a period between t1 and t2, the second transistor T2 may be turned off, and the third transistor T3 may be turned on, so that the initialization voltage VINIT having the first voltage level (e.g., 2 V) may be applied to the second node through the third transistor T3. The initialization voltage VINIT may rise to the second voltage level (e.g., 10 V) at t2. As shown in FIG. 8, in a period between t2 and t3, the initialization voltage VINIT having the second voltage level may be applied to the second node through the third transistor T3. When the initialization voltage VINIT having the second voltage level is applied to the second node, the voltage VA of the anode electrode may rise to the voltage level that may turn on the light emitting element EE. The initialization signal S2 may fall to the inactivation level at t3. As shown in FIG. 9, in a period between t3 and t4, the second transistor T2 may be turned off, and the third transistor T3 may be turned off, so that the initialization voltage VINIT may not be applied to the second node through the third transistor T3. The initialization voltage VINIT may fall to the first voltage level at t4.

As described above, in a case that the scan signal S1 falls at t1, the initialization voltage VINIT rises to the second voltage level at t2, the initialization signal S2 falls at t3, and the initialization voltage VINIT falls to the first voltage level at t4, an influence of the initialization voltage VINIT, which is the pulse voltage, on the gate signal GS or the data voltage VDATA may be minimized. Therefore, according to the display device 100, upon the operation in the variable frame mode, the initialization voltage VINIT may be provided to the pixel PX as the pulse voltage, so that the decrease in the luminance caused by the difference between the initialization period in the low-frequency region and the initialization period in the high-frequency region may be prevented, and simultaneously, the influence on the gate signal GS or the data voltage VDATA caused by the application of the pulse voltage may be effectively minimized.

Figure 10:
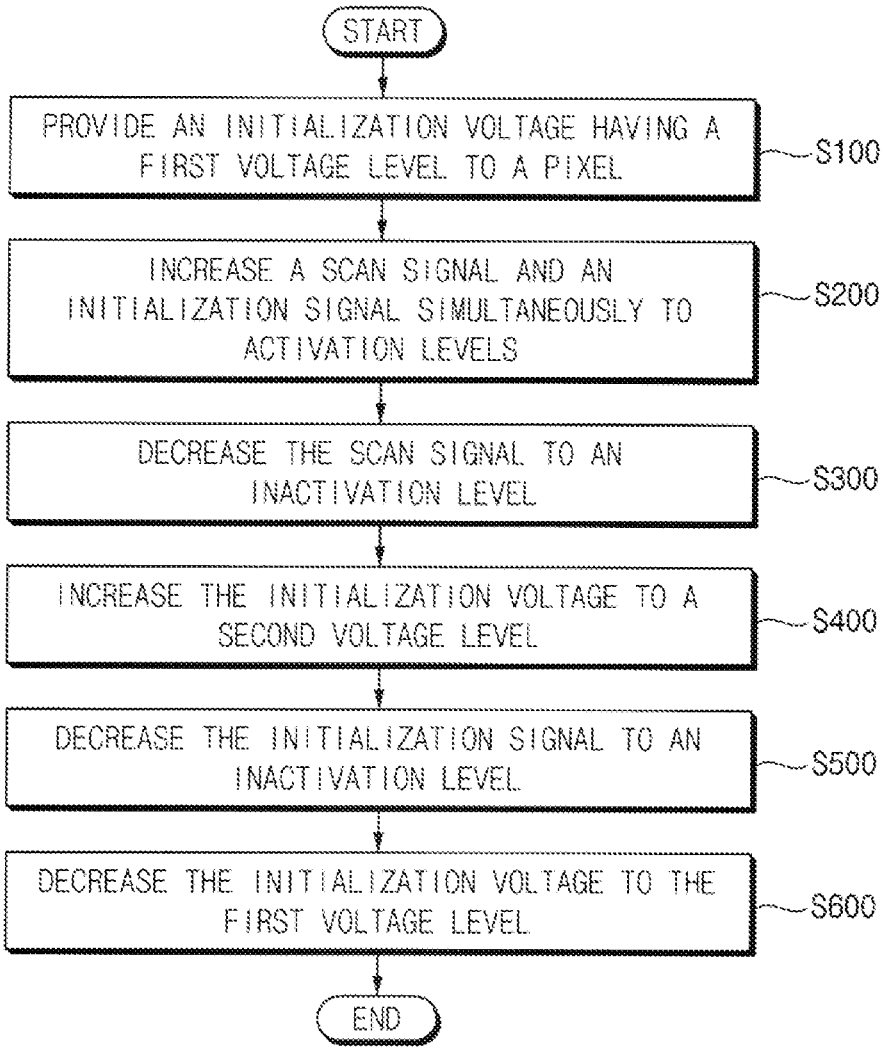
FIG. 10 is a flowchart showing an operation of a display device according to embodiments.

FIG. 10 is a flowchart showing an operation of a display device according to embodiments.

Referring to FIGS. 1, 6, and 10, according to the present disclosure, a display device 100 may provide an initialization voltage VINIT having a first voltage level to a pixel PX (S100), may increase a scan signal and an initialization signal simultaneously to activation levels (S200), may decrease the scan signal to an inactivation level (S300), may increase the initialization voltage VINIT to a second voltage level (S400), may decrease the initialization signal to an inactivation level (S500), and may decrease the initialization voltage VINIT to the first voltage level (S600), sequentially.

In an embodiment, upon an operation in a variable frame mode, the display device 100 may provide the initialization voltage VINIT having the first voltage level to the pixel PX (S100). In the data writing period, the power supply voltage generation circuit 140 may provide the initialization voltage VINIT having the first voltage level to pixels PX. For example, the first voltage level may be 2 V. The data writing period may include an initialization period. The data writing period may be substantially the same as the initialization period. At the start of the data writing period, the scan signal S1 and the initialization signal S2 may simultaneously rise to the activation levels (S200). In other words, a turn-on timing of a second transistor T2 may be identical to or substantially the same as a turn-on timing of a third transistor T3. In the data writing period, a storage capacitor CS may be charged with an electric charge corresponding to a potential difference (VDATA−VINIT) between opposite ends of the storage capacitor CS. In the data writing period, a voltage VA of an anode electrode of a light emitting element EE may be the initialization voltage VINIT.

In an embodiment, the display device 100 may decrease the scan signal to the inactivation level (S300), may increase the initialization voltage VINIT to the second voltage level (S400), may decrease the initialization signal to the inactivation level (S500), and may decrease the initialization voltage VINIT to the first voltage level (S600). In detail, at t1, the gate driver 130 may decrease the scan signal S1 to the inactivation level. In the period between t1 and t2, the second transistor T2 may be turned off, and the third transistor T3 may be turned on, so that the initialization voltage VINIT having the first voltage level may be applied to a second node through the third transistor T3. At t2, the power supply voltage generation circuit 140 may increase the initialization voltage VINIT to the second voltage level. In the period between t2 and t3, the initialization voltage VINIT having the second voltage level may be applied to the second node through the third transistor T3. When the initialization voltage VINIT having the second voltage level is applied to the second node, the voltage VA of the anode electrode may rise to a voltage level that may turn on the light emitting element EE. At t3, the gate driver 130 may decrease the initialization signal S2 to the inactivation level. In the period between t3 and t4, the second transistor T2 may be turned off, and the third transistor T3 may be turned off, so that the initialization voltage VINIT may not be applied to the second node through the third transistor T3. At t4, the power supply voltage generation circuit 140 may decrease the initialization voltage VINIT to the first voltage level.

As described above, when the scan signal S1 falls at t1, the initialization voltage VINIT rises to the second voltage level at t2, the initialization signal S2 falls at t3, and the initialization voltage VINIT falls to the first voltage level at t4, an influence of the initialization voltage VINIT, which is a pulse voltage, on the gate signal GS or the data voltage VDATA may be minimized. Therefore, according to the display device 100, upon the operation in the variable frame mode, the initialization voltage VINIT may be provided to the pixel PX as the pulse voltage, so that the decrease in the luminance caused by the difference between the initialization period in the low-frequency region and the initialization period in the high-frequency region may be prevented, and simultaneously, the influence on the gate signal GS or the data voltage VDATA caused by the application of the pulse voltage may be effectively minimized.

Figure 11:
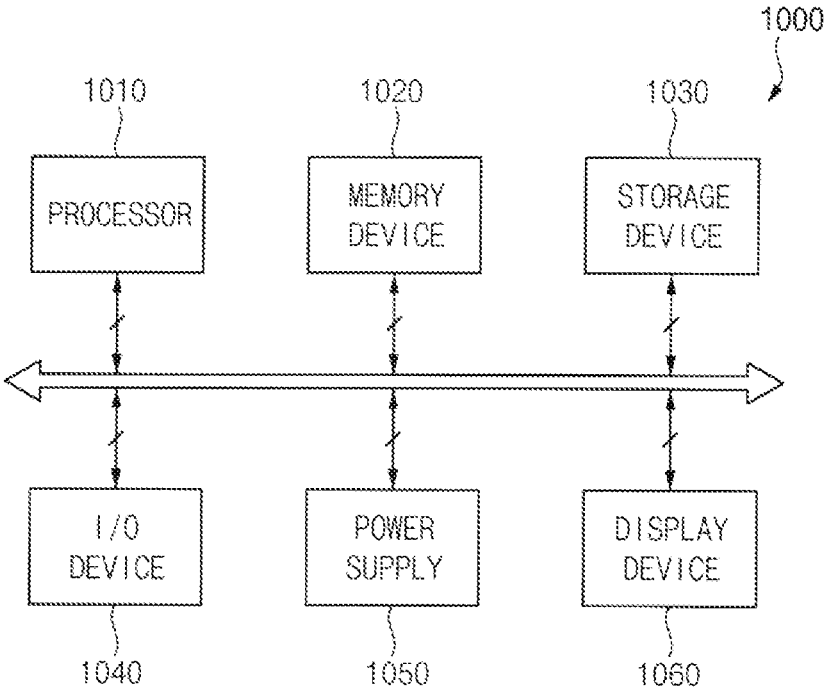
FIG. 11 is a block diagram showing an electronic device according to embodiments.
Figure 12:
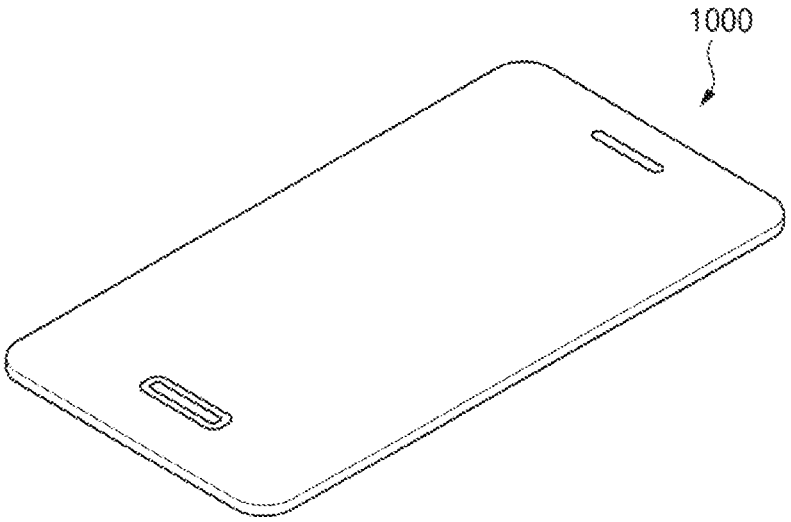
FIG. 12 is a diagram showing an example in which the electronic device of FIG. 11 is implemented as a smart phone.

FIG. 11 is a block diagram showing an electronic device according to embodiments, and FIG. 12 is a diagram showing an example in which the electronic device of FIG. 11 is implemented as a smart phone.

Referring to FIGS. 11 and 12, the electronic device 1000 may include a processor 1010, a memory device 1020, a storage device 1030, an input/output ("I/O") device 1040, a power supply 1050, and a display device 1060. Here, the display device 1060 may be the display device 100 of FIG. 1. In addition, the electronic device 1000 may further include a plurality of ports for communicating with a video card, a sound card, a memory card, a universal serial bus ("USB") device, other electronic devices, etc. In an embodiment, as shown in FIG. 12, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display ("HMD") device, etc.

The processor 1010 may perform various computing functions. The processor 1010 may be a micro processor, a central processing unit ("CPU"), an application processor ("AP"), etc. The processor 1010 may be coupled to other components via an address bus, a control bus, a data bus, etc. Further, the processor 1010 may be coupled to an extended bus such as a peripheral component interconnection ("PCI") bus. The memory device 1020 may store data for operations of the electronic device 1000. For example, the memory device 1020 may include at least one non-volatile memory device such as an erasable programmable read-only memory ("EPROM") device, an electrically erasable programmable read-only memory ("EEPROM") device, a flash memory device, a phase change random access memory ("PRAM")

device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc. and/or at least one volatile memory device such as a dynamic random access memory ("DRAM") device, a static random access memory ("SRAM") device, a mobile DRAM device, etc. The storage device 1030 may include a solid state drive ("SSD") device, a hard disk drive ("HDD") device, a CD-ROM device, etc. The I/O device 1040 may include an input device such as a keyboard, a keypad, a mouse device, a touch pad, a touch screen, etc, and an output device such as a printer, a speaker, etc. In some embodiments, the I/O device 1040 may include the display device 1060. The power supply 1050 may provide power for operations of the electronic device 1000. The display device 1060 may be coupled to other components via the buses or other communication links.

The display device 1060 may display an image corresponding to visual information of the electronic device 1000. Here, the display device 1060 may include a display panel including a plurality of pixels, a data driver which provides data voltages to the pixels, a gate driver which provides a scan signal and an initialization signal to the pixels, a power supply voltage generation circuit which provides a driving voltage to the data driver and the pixels, and a controller which controls the data driver, the gate driver, and the power supply voltage generation circuit. Upon an operation in a variable frame mode, the power supply voltage generation circuit may provide an initialization voltage having a first voltage level to the pixels. In a data writing period, the initialization voltage may further include a pulse voltage such that the initialization voltage VINIT may have a second voltage level that is greater than the first voltage level. According to the display device 1060, upon the operation in the variable frame mode, the initialization voltage may be provided to the pixel as a pulse voltage, so that a decrease in a luminance caused by a difference between an initialization period in a low-frequency region and an initialization period in a high-frequency region may be prevented, and image quality may be effectively improved. Since these are described above, duplicated description related thereto will not be repeated.

The present disclosure may be applied to a display device that supports a variable frame mode and an electronic device including the display device. For example, the present disclosure may be applied to a television ("TV"), a digital TV, a three-dimensional ("3D") TV, a cellular phone, a smart phone, a personal computer ("PC"), a tablet PC, a laptop, a home electronic device, a personal digital assistants ("PDA"), a portable multimedia player ("PMP"), a digital camera, a music player, a portable game console, a car navigation system, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A pixel comprising:

a light emitting element;

a first transistor which drives the light emitting element;

a second transistor electrically connected between a gate node of the first transistor and a data line;

a third transistor electrically connected between a first node of the first transistor and an initialization voltage line; and a storage capacitor electrically connected between the gate node and the first node of the first transistor, wherein, upon an operation in a variable frame mode, an initialization voltage is applied to the initialization voltage line, and the initialization voltage has a first voltage level, and wherein, in a data writing period during which the storage capacitor is charged with an electric charge, the initialization voltage further includes a pulse voltage such that the initialization voltage has a second voltage level that is greater than the first voltage level, wherein a scan signal for controlling input of a data voltage is applied to a gate node of the second transistor, and an initialization signal for controlling input of the initialization voltage is applied to a gate node of the third transistor, wherein the initialization voltage rises to the second voltage level after the scan signal falls to an inactivation level thereof and before the initialization signal falls to an inactivation level thereof.

2. The pixel of claim 1, wherein, in the data writing period, the scan signal and the initialization signal simultaneously rise to activation levels thereof, respectively, and the initialization signal falls to the inactivation level thereof after the scan signal falls to the inactivation level thereof.

3. The pixel of claim 1, wherein the initialization voltage falls to the first voltage level after the initialization signal falls to the inactivation level thereof.

4. The pixel of claim 1, wherein, in the data writing period, a turn-on timing of the second transistor is identical to or substantially the same as a turn-on timing of the third transistor, and a turn-off timing of the third transistor is after a turn-off timing of the second transistor.

5. The pixel of claim 4, wherein the initialization voltage rises to the second voltage level after the second transistor is turned off and before the third transistor is turned off.

6. The pixel of claim 5, wherein the initialization voltage falls to the first voltage level after the third transistor is turned off.

7. The pixel of claim 1, wherein the second voltage level is identical to or substantially the same as a voltage level of a threshold voltage of the light emitting element.

8. The pixel of claim 1, wherein the second voltage level is settable between the first voltage level and a voltage level of a threshold voltage of the light emitting element.

9. A display device comprising:

a display panel including a plurality of pixels;

a data driver which provides data voltages to the pixels;

a gate driver which provides a scan signal and an initialization signal to the pixels;

a power supply voltage generation circuit which provides a driving voltage to the data driver and the pixels; and a controller which controls the data driver, the gate driver, and the power supply voltage generation circuit, wherein, upon an operation in a variable frame mode, the power supply voltage generation circuit provides an initialization voltage to the pixels, and the initialization voltage has a first voltage level, and wherein, in a data writing period, the initialization voltage further includes a pulse voltage such that the initialization voltage has a second voltage level that is greater than the first voltage level, wherein the power supply voltage generation circuit increases the initialization voltage to the second voltage level after the scan signal falls to an inactivation level thereof and before the initialization signal falls to an inactivation level thereof.

10. The display device of claim 9, wherein, in the data writing period, the scan signal and the initialization signal simultaneously rise to activation levels thereof, respectively, and the initialization signal falls to the inactivation level thereof after the scan signal falls to the inactivation level thereof.

11. The display device of claim 9, wherein the power supply voltage generation circuit decreases the initialization voltage to the first voltage level after the initialization signal falls to the inactivation level thereof.

12. The display device of claim 9, wherein the pixel includes:

a light emitting element;

a first transistor which drives the light emitting element;

a second transistor electrically connected between a gate node of the first transistor and a data line;

a third transistor electrically connected between a first node of the first transistor and an initialization voltage line; and a storage capacitor electrically connected between the gate node and the first node of the first transistor.

13. The display device of claim 12, wherein the second voltage level is identical to or substantially the same as a voltage level of a threshold voltage of the light emitting element.

14. A method of driving a display device, the method comprising:

providing an initialization voltage to a pixel, wherein the initialization voltage has a first voltage level;

providing a scan signal to the pixel;

providing an initialization signal to the pixel; and controlling the initialization voltage, wherein, in a data writing period, the initialization voltage further includes a pulse voltage such that the initialization voltage has a second voltage level that is greater than the first voltage level, wherein controlling the initialization voltage includes:

increasing the initialization voltage to the second voltage level after the scan signal falls to an inactivation level thereof and before the initialization signal falls to an inactivation level thereof.

15. The method of claim 14, wherein, in the data writing period, the scan signal and the initialization signal simultaneously rise to activation levels thereof, respectively, and the initialization signal falls to the inactivation level thereof after the scan signal falls to the inactivation level thereof.

16. The method of claim 14, wherein controlling the initialization voltage includes:

decreasing the initialization voltage to the first voltage level after the initialization signal falls to the inactivation level thereof.

* * * * *